US008690142B2

(12) United States Patent
Nagata

(10) Patent No.: US 8,690,142 B2
(45) Date of Patent: Apr. 8, 2014

(54) POST-PROCESSING DEVICE AND PAPER PROCESSING APPARATUS

(75) Inventor: Jinichi Nagata, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/569,280

(22) Filed: Aug. 8, 2012

(65) Prior Publication Data

US 2013/0049279 A1 Feb. 28, 2013

(30) Foreign Application Priority Data

Aug. 29, 2011 (JP) ..... 2011-185468

(51) Int. Cl.
*B65H 31/00* (2006.01)

(52) U.S. Cl.
USPC ..... 270/58.04; 270/58.07

(58) Field of Classification Search
USPC ..... 270/58.01, 58.04, 58.07; 399/407
See application file for complete search history.

(56) References Cited

U.S. PATENT DOCUMENTS 6,962,331 B2 * 11/2005 Matsumoto et al. ..... 270/58.09
7,198,261 B2 * 4/2007 Matsumoto et al. ..... 270/58.09
8,047,524 B2 * 11/2011 Iguchi et al. ..... 270/58.11
8,226,080 B2 * 7/2012 Morita et al. ..... 270/58.13
2006/0202403 A1 9/2006 Nagata et al.
2007/0284809 A1 12/2007 Murata et al.
2011/0006476 A1 * 1/2011 Morita et al. ..... 271/265.04

FOREIGN PATENT DOCUMENTS

JP 2004-262595 A 9/2004
JP 2006-248685 A 9/2006
JP 2007-084269 A 4/2007

* cited by examiner

*Primary Examiner* — Leslie A Nicholson, III
(74) *Attorney, Agent, or Firm* — Renner, Otto, Boisselle & Sklar, LLP

(57) ABSTRACT

A post-processing device includes an introductory conveying path, a processing tray, a paper receiving tray, an upper paper discharge roller, a lower paper discharge roller and a control section. The upper paper discharge roller and the lower paper discharge roller are disposed at an edge portion on the paper receiving tray's side of the processing tray. The upper paper discharge roller is capable of coming into contact with and away from the lower paper discharge roller. The control section causes the upper paper discharge roller to start a descending motion with a timing such that the upper paper discharge roller comes into contact with paper before the paper comes into contact with the paper receiving tray if the paper belongs to a second kind, where the paper of the second kind is lighter weight than that of a first kind.

6 Claims, 10 Drawing Sheets

FIG.9

| PAPER CLASS | PAPER THICKNESS | PAPER SIZE | DESCENDING START TIMING |
|---|---|---|---|
| SECOND KIND | THIN PAPER | NOT LARGER THAN A4 | EARLY |
| | | LARGER THAN A4 | |
| | NORMAL | NOT LARGER THAN A4 | |
| FIRST KIND | | LARGER THAN A4 | NORMAL |
| | THICK PAPER | NOT LARGER THAN A4 | |
| | | LARGER THAN A4 | |
| | OTHER SPECIAL PAPER | ——— | |

POST-PROCESSING DEVICE AND PAPER PROCESSING APPARATUS

CROSS REFERENCE

This Nonprovisional application claims priority under 35 U.S.C. §119(a) on Patent Application No. 2011-185468 filed in Japan on Aug. 29, 2011, the entire contents of which are hereby incorporated by reference.

BACKGROUND OF THE INVENTION

The present invention relates to a post-processing device that is installed in a paper processing apparatus having a paper processing section applying a predetermined process to paper and that performs a post-processing for the paper that has undergone the predetermined process in the paper processing section, and to a paper processing apparatus provided with the post-processing device.

Among some paper processing apparatus such as image forming apparatus are those provided with a post-processing device configured so as to perform a binding process such as stapling process, a perforation process and an offset process.

The post-processing device typically includes an introductory conveying path conveying paper introduced from the paper processing section such as image forming section, a processing tray onto which the paper having passed through the introductory conveying path is placed, and a paper receiving tray onto which the paper is discharged from the processing tray after having undergone a post-processing on the processing tray (for example, refer to Japanese Patent Unexamined Publication No. 2006-248685 bulletin).

In such a post-processing device, as shown in FIG. 1A through FIG. 1C, most part of a paper sheet 80 is typically once placed onto the paper receiving tray 28 with an upper paper discharge roller 229 and a lower paper discharge roller 244 disposed in a state of being away from each other, until the rear end portion of the paper sheet 80 reaches between the upper paper discharge roller 229 and the lower paper discharge roller 244 when the paper sheet 80 to be post-processed passes through the introductory conveying path 222. Thereafter, when the rear end portion of the paper sheet 80 has reached between the upper paper discharge roller 229 and the lower paper discharge roller 244, the paper sheet 80 is drawn into the processing tray 24 by the upper paper discharge roller 229 and the lower paper discharge roller 244 rotating together while the upper paper discharge roller 229 contacts with the lower paper discharge roller 244 with pressure. On the processing tray 24, it is necessary for the paper sheets 80 to be placed at a predetermined alignment position in order that the paper sheets 80 are accurately post-processed.

In conventional post-processing devices, however, if the paper sheet 80 is of relatively light weight such as thin paper, small-sized paper and/or the like, variation in the distribution of the paper sheets 80 increases that are conveyed from the introductory conveying path 222 to the paper receiving tray 28, as shown in FIG. 2A and FIG. 2B. The reason being that after passing through the introductory conveying path 222 the paper sheet 80 is never gripped by any pairs of rollers until it is gripped at its rear end portion by the upper paper discharge roller 229 and the lower paper discharge roller 244. To put it concretely, when the paper sheet 80 is conveyed from the introductory conveying path 222 to the paper receiving tray 28, and if the paper sheet 80 is relatively heavy, the paper sheet 80 is placed at a generally fixed position on the paper receiving tray 28 by its own weight. On the other hand, if the paper sheet 80 is of relatively lightweight, the paper sheets 80 are likely to be scattered on the paper receiving tray 28 by the impetus at the time when they are each discharged from the introductory conveying path 222, and in particular, ways of sliding and bouncing of the paper sheets 80 after the leading edge of the paper sheets 80 have each collided against the paper receiving tray 28 are varied, thereby increasing the variation in the distribution of the paper sheets 80 on the paper receiving tray 28. If the variation in the distribution of the paper sheets 80 is large on the paper receiving tray 28, alignment of the paper sheets 80 drawn onto the processing tray 24 becomes untidy, resulting in a problem that accuracy in performing the post-processing of the paper sheet(s) 80 deteriorates.

The present invention is directed to providing a post-processing device capable of increasing the alignment of paper on a processing tray by controlling a variation in the distribution of paper conveyed from an introductory conveying path to a paper receiving tray, and a paper processing apparatus provided with the post-processing device.

SUMMARY OF THE INVENTION

A post-processing device according to the present invention performs a post-processing for paper that has undergone a predetermined process. The post-processing device comprises an introductory conveying path, a processing tray, a post-processing section, a paper receiving tray, a paper discharge section and a control section. Into the introductory conveying path is introduced the paper that has undergone a predetermined process. Onto the processing tray is placed the paper that has passed through the introductory conveying path. The post-processing section performs a post-processing for the paper on the processing tray. Onto the paper receiving tray is placed the paper that is discharged from the processing tray after having been post-processed by the post-processing section. The paper discharge section includes a lower rotary body disposed at an edge portion on the paper receiving tray's side of the processing tray, and an upper rotary body installed so as to be capable of coming into contact with and away from the lower rotary body. The paper discharge section is freely rotatable in both a reverse conveyance direction by which the paper conveyed from the introductory conveying path onto the paper receiving tray is pulled back to the processing tray and a forward conveyance direction by which the paper placed on the processing tray is discharged onto the paper receiving tray. The control section controls an operation of the paper discharge section. The control section causes a timing of start of a descending motion of the upper rotary body at the time when the paper is conveyed from the introductory conveying path to the paper receiving tray to become earlier if the paper belongs to a predetermined second kind than if the paper belongs to a predetermined first kind, where the paper of the second kind is lighter weight than that of the first kind, and then causes the upper rotary body to start the descending motion with the timing such that the upper rotary body comes into contact with the paper before the paper comes into contact with the paper receiving tray if the paper belongs to the second kind.

With this configuration, if the paper is relatively lightweight so that it belongs to the second kind, the upper rotary body comes into contact with the paper before the paper comes into contact with the paper receiving tray when the paper is conveyed from the introductory conveying path to the paper receiving tray. As a result, the impetus of the paper running out from the introductory conveying path to the paper receiving tray is reduced by a frictional force between the paper and the upper rotary body. Therefore, degrees of sliding and bouncing of the paper after the leading edge of the paper has collided against the paper receiving tray is decreased, thereby suppressing the variation in the distribution of paper on the paper receiving tray.

The present invention makes it possible to achieve an improved alignment of paper on a processing tray by controlling a variation in the distribution of paper conveyed from an introductory conveying path to a paper receiving tray.

BRIEF DESCRIPTION OF THE DRAWINGS

FIG. 9 is a diagram showing an example of a relationship between a kind of paper and a timing of start of a descending motion of an upper paper discharge roller.

DETAILED DESCRIPTION OF THE INVENTION

Figure 1A:
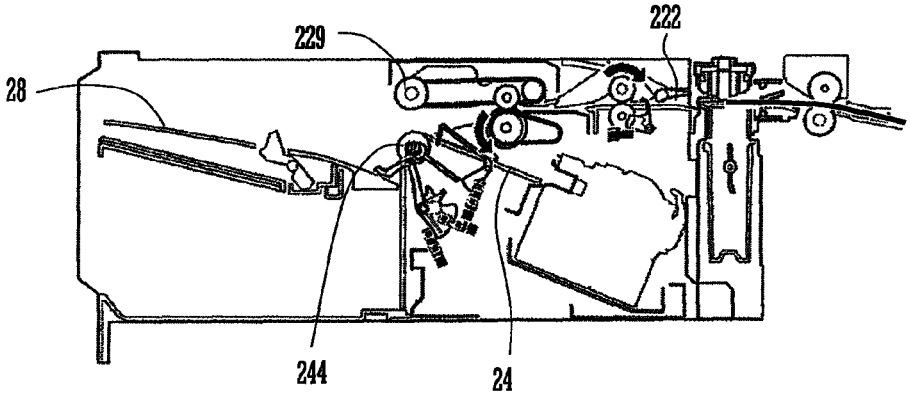
PRIOR ART FIG.1A
FIG. 1A thorough FIG. 1C are drawings showing an example of a conveyance procedure for a conventional post-processing device.
Figure 1B:
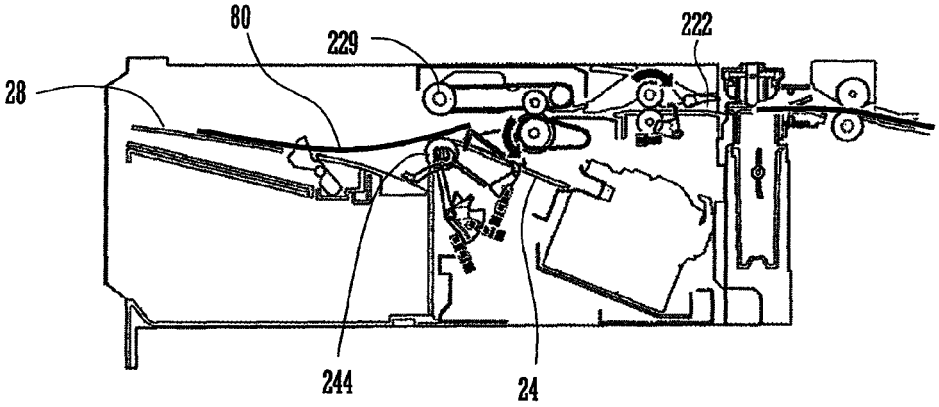
Figure 1C:
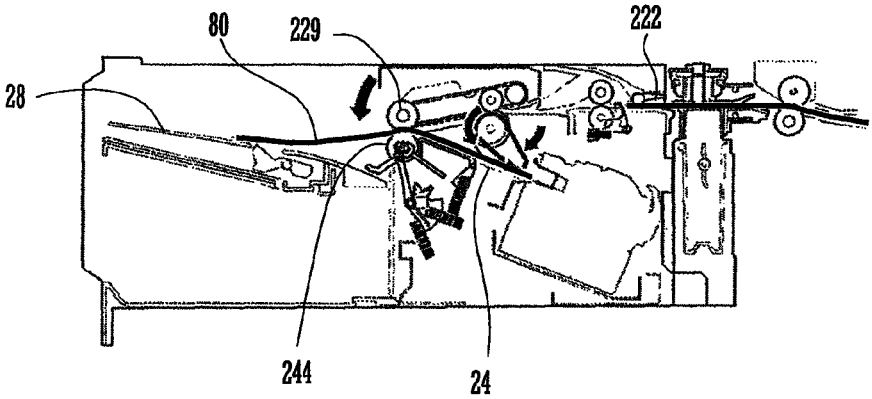
Figure 2A:
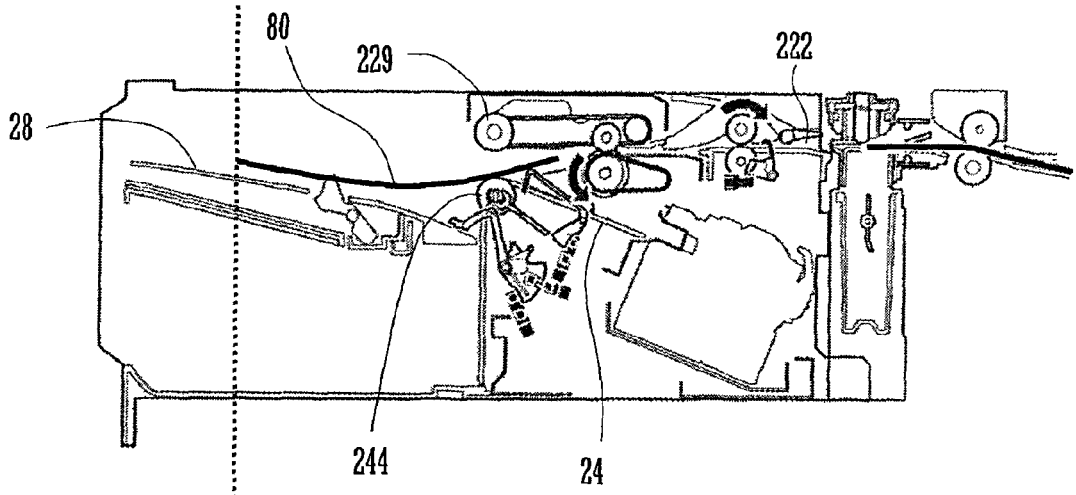
PRIOR ART FIG.2A
FIG. 2A and FIG. 2B are drawings showing an example of the conveyance procedure for the conventional post-processing device.
Figure 2B:
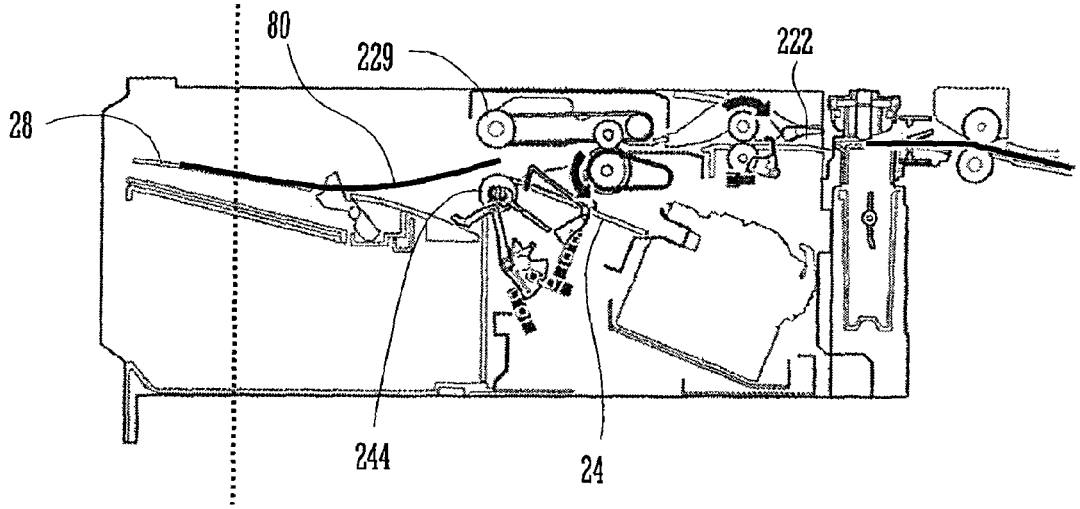
Figure 3:
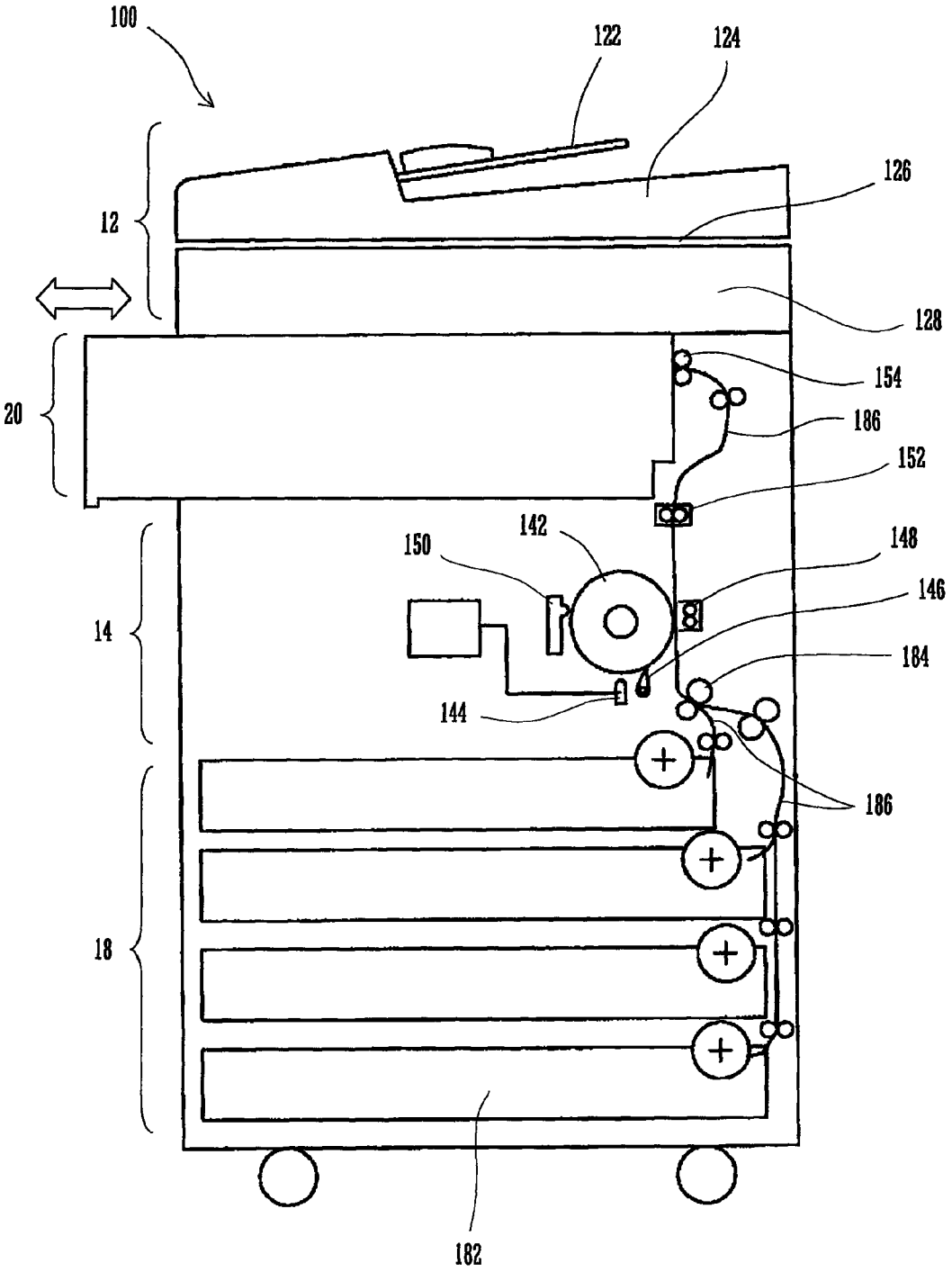
FIG. 3 is a drawing showing a configurative outline of an image forming apparatus according to an embodiment of a paper processing apparatus of the present invention.

An embodiment of the present invention is explained below referring to the drawings. FIG. 3 shows a configurative outline of an image forming apparatus 100 to which a post-processing apparatus according to an embodiment of the present invention is applied. The image forming apparatus 100 is an example of the paper processing apparatus. The image forming apparatus 100 includes an image reading section 12 to read an image of a document and produce image data, an image forming section 14 to carry out an image forming process onto paper, a paper feeding section 18 to supply paper sequentially to the image forming section 14, and a post-processing device 20 to carry out a post-processing for the paper that has undergone the image forming process at the image forming section 14.

The image reading section 12 includes an optical system unit 128 configured so as to read an image of a document on a document table 126, and an automatic document conveyance unit 124 to convey a document on a document load table 122 sequentially to a document reading position of the document table 126.

The image forming section 14 includes a photoreceptor drum 142 as image bearing member disposed so as to contact with a paper conveying path 186. Around the photoreceptor drum 142 are disposed an exposure device 144, a developing device 146, a transfer device 148 and a cleaning unit 150. The exposure device 144 forms an electrostatic latent image on the photoreceptor drum 142 by exposing the photoreceptor drum 142. The developing device 146 develops the electrostatic latent image on the photoreceptor drum 142 by supplying a developer to the photoreceptor drum 142. The transfer device 148 transfers a developer image on the photoreceptor drum 142 onto paper. The cleaning unit 150 collects the developer and the like remaining on the photoreceptor drum 142.

The image forming section 14 further includes a fuser unit 152 installed downstream from the photoreceptor drum 142 in the paper conveying path 186. The fuser unit 152 fixes the developer image that has been transferred onto paper on the paper by heat and pressure. On the downstream side from the fuser unit 152 in the paper conveying path 186 is installed an introduction roller 154 to introduce the paper having undergone the image forming into the post-processing device 20.

The paper feeding section 18 is provided with a plurality of paper receptacle cassettes 182 to receive paper. Each paper receptacle cassette 182 is equipped with a send-out mechanism to send the paper out piece by piece to the paper conveying path 186. The paper feeding section 18 is further provided with a pair of paper stop rollers 184 to adjust a timing of supplying the paper to the image forming section 14.

Figure 4:
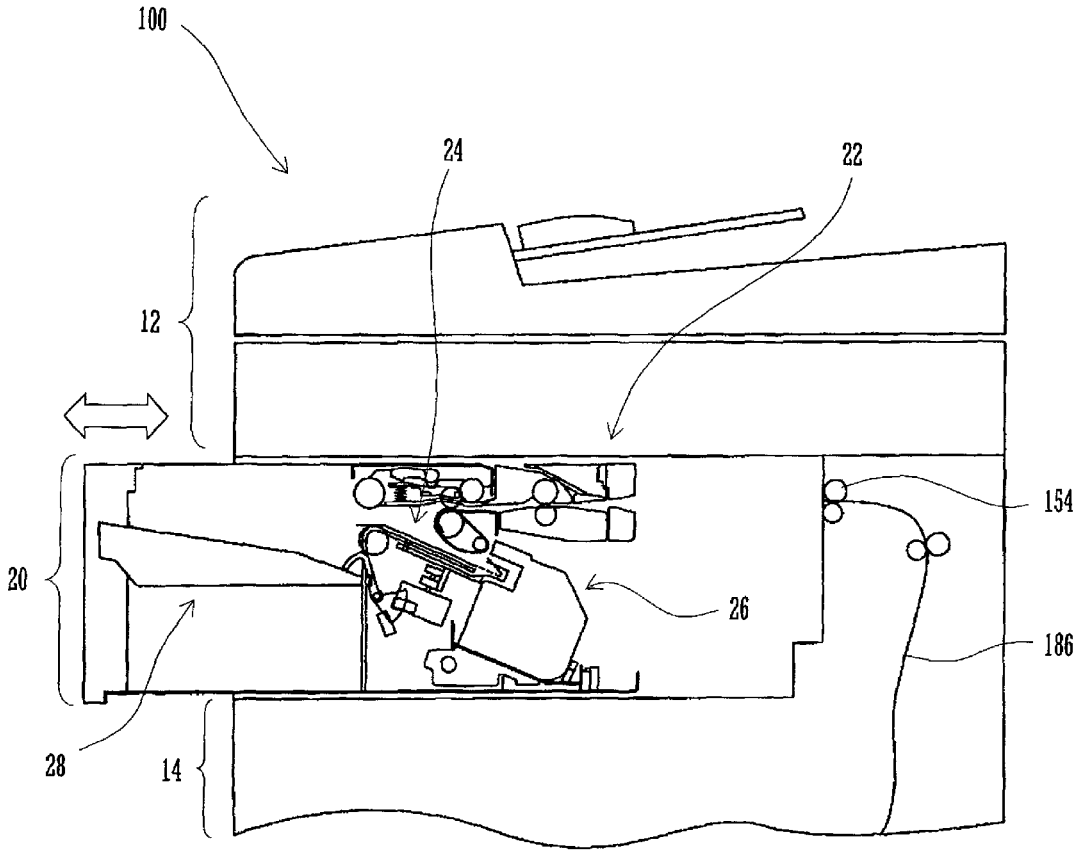
FIG. 4 is a drawing showing a configurative outline of a post-processing device.

As shown in FIG. 4, the post-processing device 20 is configured so as to be detachable from a main body of the image forming apparatus 100. FIG. 3 and FIG. 4 show a state in which the post-processing device 20 is drawn from the image forming apparatus 10. The post-processing device 20 is, when attached to the main body of the image forming apparatus 100, placed between the image reading section 12 and the image forming section 14.

The post-processing device 20 comprises an introductory conveying section 22, a processing tray 24, a post-processing section 26 and a paper receiving tray 28. The introductory conveying section 22 conveys the paper introduced into the post-processing device 20 by the introductory roller 154 toward the processing tray 24 and the paper receiving tray 28. The introductory conveying section 22 is connected to the paper conveying path 186 in a state where the post-processing device 20 is pushed into the image forming apparatus 100. The processing tray 24 is disposed in a region from an underside of the introductory conveying section 22 to a downstream side in a paper conveying direction, and is configured so as to temporarily contain a bunch of paper sheets to be processed by the post-processing section 26. The post-processing section 26 is configured so as to perform a binding process such as staple process or the like and perforation process for the paper placed on the processing tray 24. The paper receiving tray 28 is disposed on the downstream side from the processing tray 24 in the paper conveying direction in the introductory conveying section 22, and is configured so as to contain the paper discharged from the processing tray 24 after having been processed by the post-processing section 26. An upstream edge portion of the paper receiving tray 28 is disposed below a downstream edge portion of the processing tray 24. The paper receiving tray 28 is inclined upward toward the downstream side.

Figure 5:
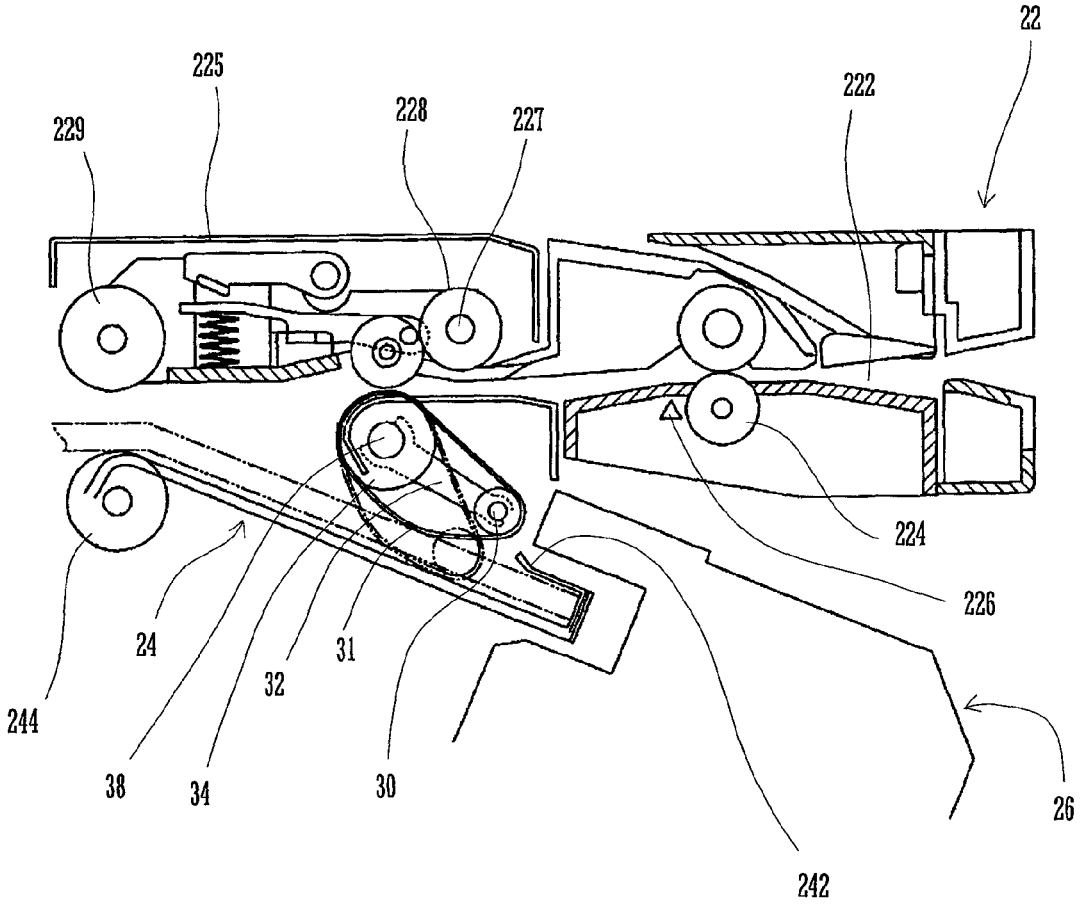
FIG. 5 is a drawing showing a configuration including an introductory conveying section, a processing tray, a post-processing section and a paper receiving tray.

As shown in FIG. 5, in the introductory conveying section 22 is formed an introductory conveying path 222 to convey the paper sent from the image forming section 14 in a horizontal direction. Along the introductory conveying path 222 are disposed a pair of conveyance rollers 224 and a pair of conveyance rollers 34. In the proximity of a downstream side from the conveyance roller 224 in the introductory conveying path 222 is provided with a paper sensor 226 configured so as to detect a leading edge and a rear edge of the paper conveyed. The conveyance roller 34 is configured so as to discharge the paper, which has passed through the introductory conveying path 222 and is to be processed, to the processing tray 24.

At an edge portion of the processing tray 24 on the paper receiving tray 28's side are installed an upper paper discharge roller 229 and a lower paper discharge roller 244. The upper paper discharge roller 229 is supported by the shaft thereof at the downstream edge portion of a paper discharge mechanism 225 in the paper conveying direction in the introductory conveying section 22. The paper discharge mechanism 225 is configured so as to be capable of swinging in upward and downward directions around a roller shaft 227 of a drive roller 228 disposed at the upstream edge portion. The swinging motion of the paper discharge mechanism 225 in upward and downward directions allows the upper paper discharge roller 229 to come into contact with and away from the lower paper discharge roller 244. The upper paper discharge roller 229 is configured rotatably in both directions, that is to say, forward conveyance direction and reverse conveyance direction, by a driving force transmitted from the drive roller 228. The upper paper discharge roller 229 and the lower paper discharge roller 244 constitute a paper discharge section.

The paper introduced into the introductory conveying path 222 is conveyed toward the paper receiving tray 28 by the conveyance roller 224 and the conveyance roller 34. Because of a conveyance force transmitted from the conveyance roller 34, the paper moves for a while toward the paper receiving tray 28 after having been released from a grip by the conveyance roller 34. Before or at the time when the rear edge portion of the paper reaches between the upper paper discharge roller 229 and the lower paper discharge roller 244, the upper paper discharge roller 229 and the lower paper discharge roller 244 are caused to come into contact with each other with pressure. The paper most part of which is placed on the paper receiving tray 28 is pulled back to the processing tray 24 when the upper paper discharge roller 229 rotates in the reverse conveyance direction with the paper sandwiched between the upper paper discharge roller 229 and the lower paper discharge roller 244 contacting with each other with pressure. After that, the paper placed on the processing tray 24 is discharged onto the paper receiving tray 28 when the upper paper discharge roller 229 rotates in the forward conveyance direction after the post-processing has been applied to the paper on the processing tray 24.

To the conveyance roller 34 is connected a support arm 32 capable of swinging around a rotating shaft 38 of the conveyance roller 34. At a tip of the support arm 32 is supported a pulley 30 by the shaft thereof. Over the conveyance roller 34 and the pulley 30 is passed a caterpillar belt 31. The caterpillar belt 31 guides the paper on the processing tray 24 to a direction of a predetermined alignment position. In concrete terms, the caterpillar belt 31 is configured so as to transmit a conveyance force to the paper until an edge portion of the paper pulled back to the processing tray 24 from the paper receiving tray 28 comes into contact with a positioning member 242. With the edge portion of the paper coming into contact with the positioning member 242, the paper is positioned at the predetermined alignment position in the conveying direction.

The processing tray 24 is configured so as to be inclined upward toward the paper receiving tray 28's side. The paper drawn onto the processing tray 24 is guided to a bottom edge's side of the processing tray 24 by its self-weight and a driving force of the caterpillar belt 31. Method for the conveyance of paper on the processing tray 24 is not limited to such, and the paper may be guided to the alignment position by an additionally installed other conveyance roller in collaboration with the caterpillar belt 31.

Figure 6:
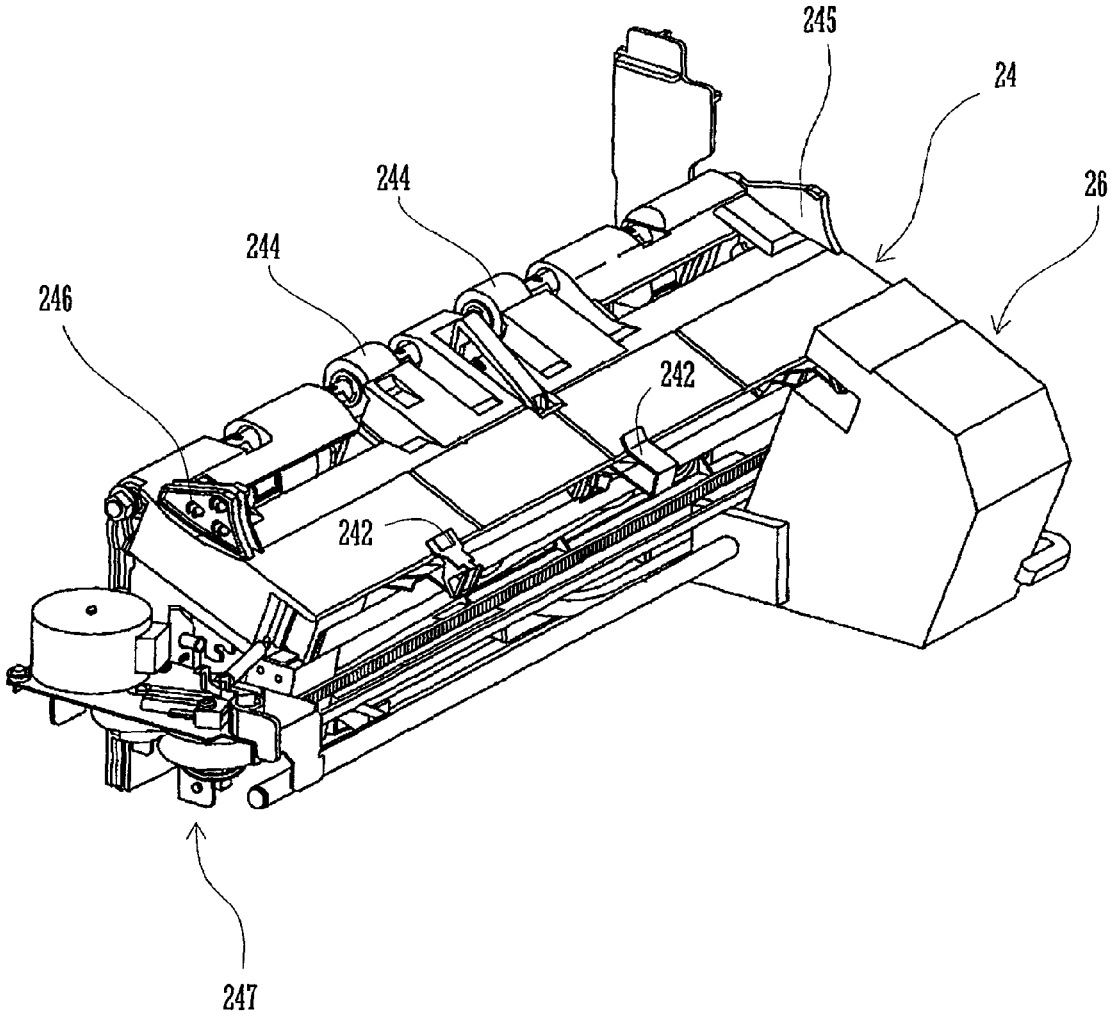
FIG. 6 is a drawing showing a configuration of the processing tray.

FIG. 6 is a drawing showing a configuration of the processing tray 24. The processing tray 24 is provided with a first alignment plate 245 and a second alignment plate 246 that are supported movably in width direction (a direction perpendicular to the paper conveying direction) of the processing tray 24. The first alignment plate 245 and the second alignment plate 246 are configured so as to be moved in the width direction of the processing tray 24 by a first drive section 247 having a motor supplying a driving force to a rack and pinion mechanism and a pinion gear that are installed inside the processing tray 24. With either edge portion of the paper in its width direction coming into contact with the first alignment plate 245 and the second alignment plate 246 respectively, the paper is aligned in the width direction. However, method for driving the first alignment plate 245 and the second alignment plate 246 is not limited to the one in the above embodiment. Additionally, in the above embodiment, the post-processing section 26 is also shown to be configured movably in the width direction of the processing tray 24; however, such is not an essential matter but an optional matter in implementing the present invention to cause the post-processing section 26 to move in the width direction of the processing tray 24.

Figure 7:
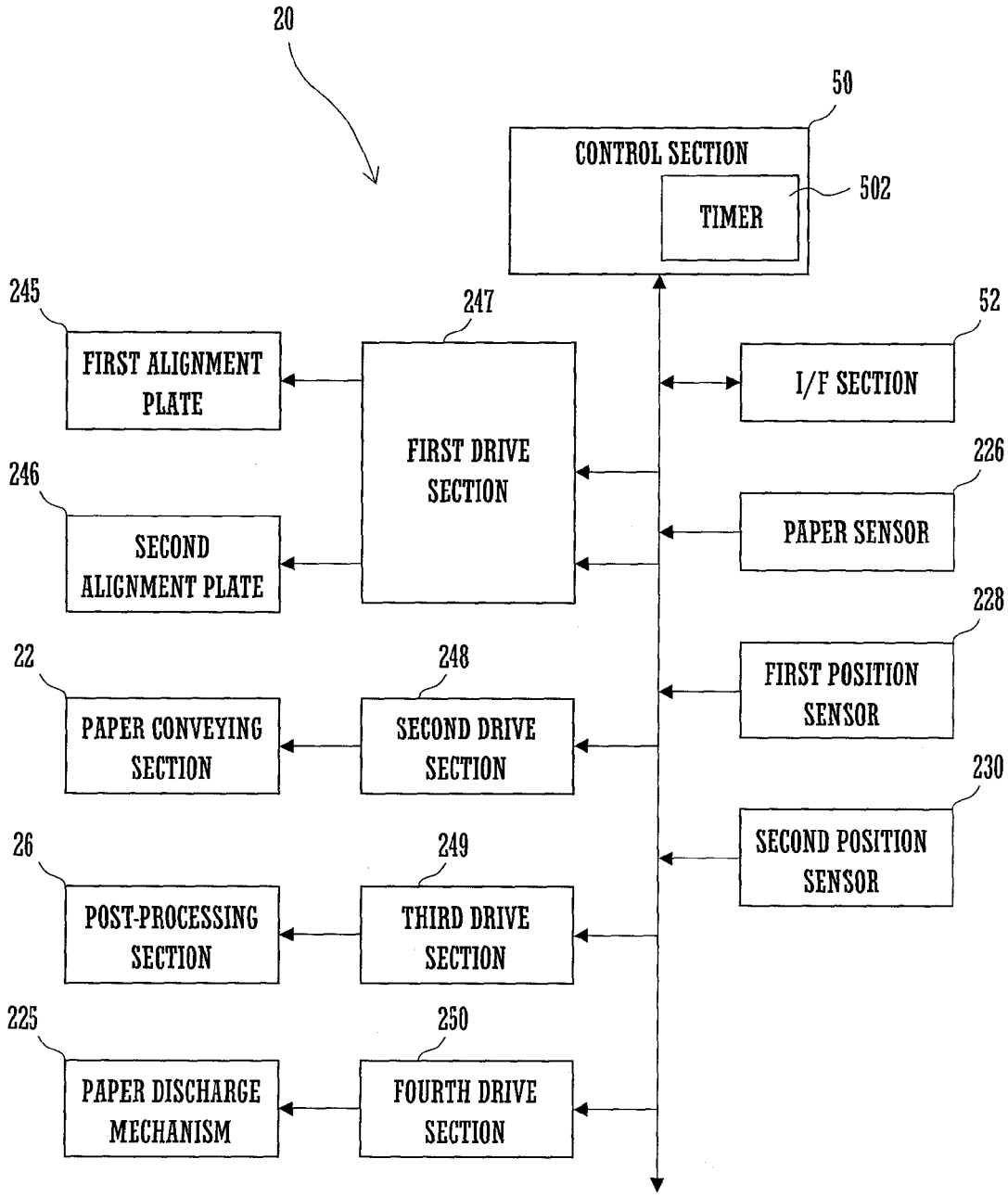
FIG. 7 is a block diagram showing a configurative outline of the post-processing device.

As shown in FIG. 7, the post-processing device 20 includes a control section 50; and to the control section 50 are connected an I/F section 52, the paper sensor 226, a first position sensor 228, a second position sensor 230, the first drive section 247, a second drive section 248, a third drive section 249 and the paper discharge mechanism 225. The control section 50 includes a timer 502. The control section 50 controls each part of the post-processing device 20 collectively.

The I/F section 52 is configured so as to receive various signals from a main control section (not illustrated) of the image forming apparatus 100. For example, to the I/F section 52 are inputted a signal showing a size and a thickness of paper being conveyed, a signal showing a kind of post-processing to be performed by the post-processing device 20, a signal ordering that the post-processing be started, and a signal showing that an image forming process has been completed for the paper.

The first position sensor 228 is configured so as to detect positions of the first alignment plate 245 and the second alignment plate 246. The second position sensor 230 is configured so as to detect a position of the post-processing section 26. The second drive section 248 is configured so as to supply a driving force to the introductory conveying section 22. The third drive section 249 is configured so as to supply a driving force to the post-processing section 26. The fourth drive section 250 is configured so as to supply a driving force to the paper discharge mechanism 225.

Figure 8:
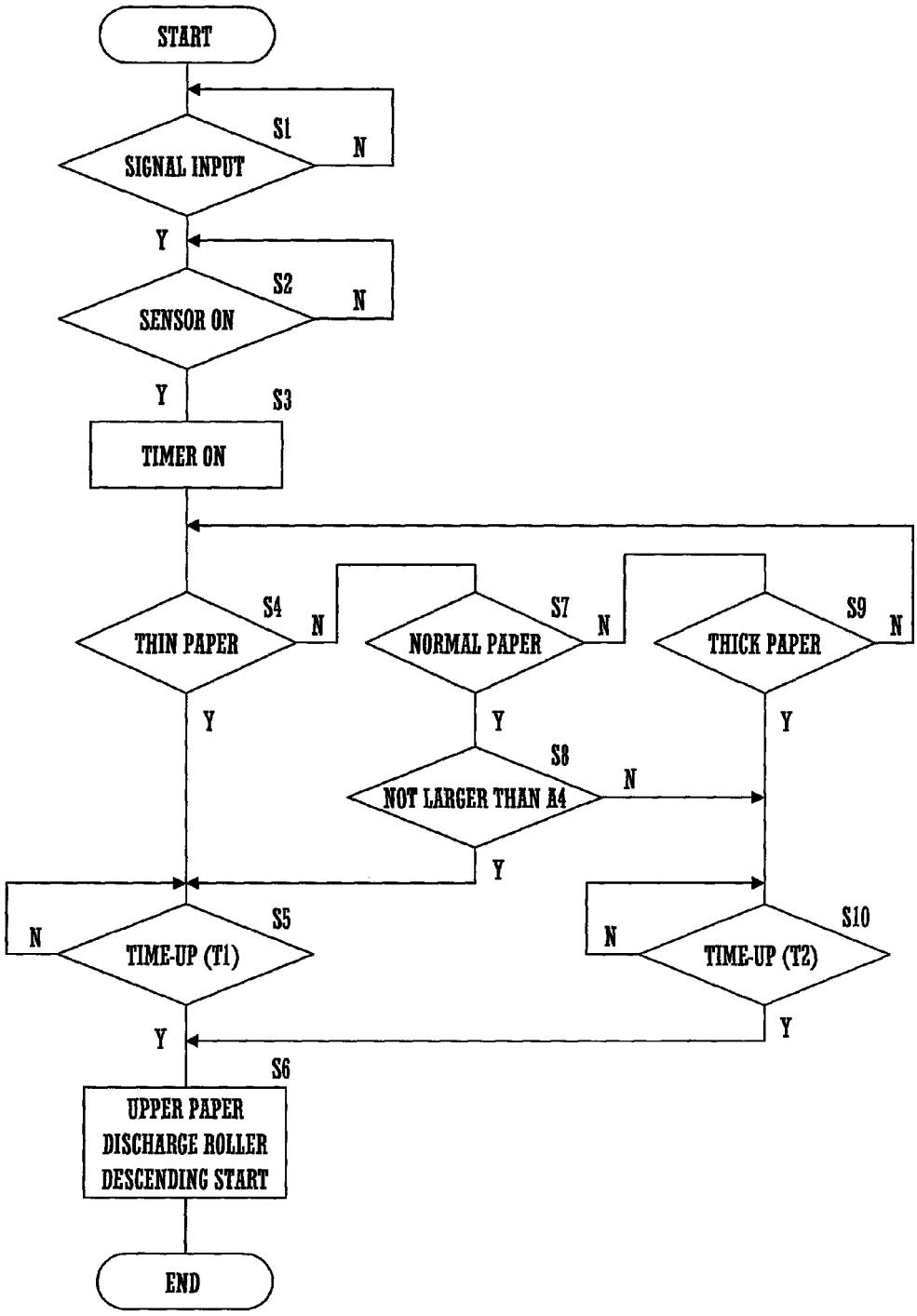
FIG. 8 is a flow chart showing an example of an operational procedure of the post-processing device.

FIG. 8 shows an example of an operational procedure by the control section 50 of the post-processing device 20. The control section 50 waits until it receives an input signal from the main control section of the image forming apparatus 100 (S1).

When the input signal is received from the main control section of the image forming apparatus 100, the control section 50 waits until the paper sensor 226 detects the leading edge of the paper (S2). When the paper sensor 226 detects the leading edge of the paper in the waiting step of S2, the control section 50 causes the built-in timer 502 to operate to start a measurement (S3).

Subsequently, the control section 50 determines the thickness of the paper presently conveyed (S4), and then waits until the timer 502 completes the count of time for a set time T1 if the paper is thin paper (S5). Here, the set time T1 is set so as to be shorter than a time required for the leading edge of the paper conveyed at a set conveyance speed to reach the paper receiving tray 28 after having passed the paper sensor 226. It is preferable that the set time T1 is set at a time obtained by subtracting a time required for the upper paper discharge roller 229 to descend to come into contact with the paper being conveyed from a time required for the leading edge of the paper to reach between the upper paper discharge roller 229 and the paper receiving tray 28 after having passed the paper sensor 226.

When the timer 502 has completed the count of time for the set time T1 in the waiting step of S5, the control section 50 causes the upper paper discharge roller 229 to start to descend by controlling the paper discharge mechanism 225 (S6).

Then, in the decision step of S4, if the paper presently conveyed is not thin paper but normal paper (S7), the control section 50 further determines whether the size of the paper presently conveyed is not larger than A4 size or larger than A4 size (S8). If the size of the paper presently conveyed is not larger than A4 size, the control section 50 advances to the above-mentioned S5 step. On the other hand, if the size of the paper presently conveyed is larger than A4 size, the control section 50 waits until the timer 502 completes the count of time for a set time T2 (S10). Here, the set time T2 is taken larger than the set time T1 in value, and the value is the same as what has been employed in conventional post-processing devices.

When the timer 502 completes the count of time for the set time T2 in the waiting step of S10, the control section 50 causes the upper paper discharge roller 229 to start to descend by controlling the paper discharge mechanism 225 (S6).

Further, in the decision step of S7, if the paper presently conveyed is not normal paper but a special kind of paper such as thick paper, glossy paper, OHP (Overhead Projector) sheet or the like (S9), the control section 50 advances to the above-mentioned S10 step.

With the above-mentioned configuration, if the paper presently conveyed is the one belonging to a first kind such as normal paper of size larger than A4, thick paper or special paper as shown in FIG. 9, the paper 80 is conveyed toward the paper receiving tray 28 in a state where the upper paper discharge roller 229 is at a raised position. Then, the upper paper discharge roller 229 starts descending after the rear edge portion of the paper 80 has reached between the upper paper discharge roller 229 and the lower paper discharge roller 244 and the paper 80 has been placed on the paper receiving tray 28, and the paper 80 is pulled back to the processing tray 24 by the upper paper discharge roller 229 that is caused to rotate in the reverse conveyance direction with the rear edge portion of the paper 80 being clamped by the upper paper discharge roller 229 and the lower paper discharge roller 244. Because the paper belonging to the first kind is relatively heavy, such paper 80 is, when conveyed from the introductory conveying path 222 to the paper receiving tray 28, placed onto a generally fixed position on the paper receiving tray 28.

Figure 10A:
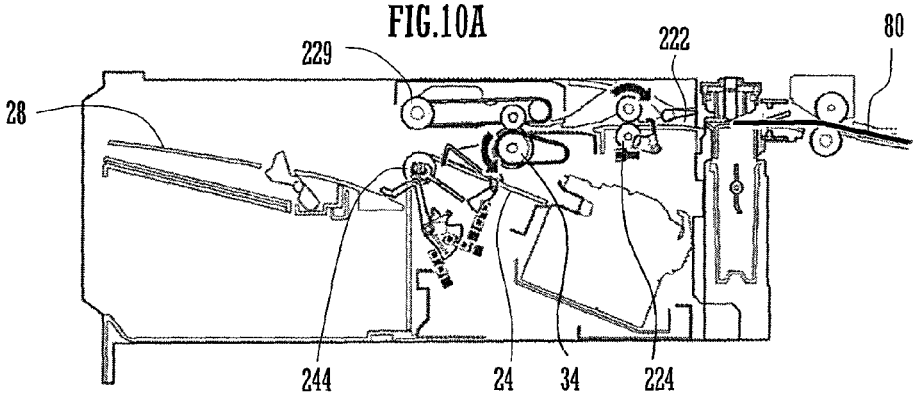
FIG. 10A through FIG. 10D are drawings showing an example of a conveyance procedure for the post-processing device according to an embodiment of the present invention.
Figure 10B:
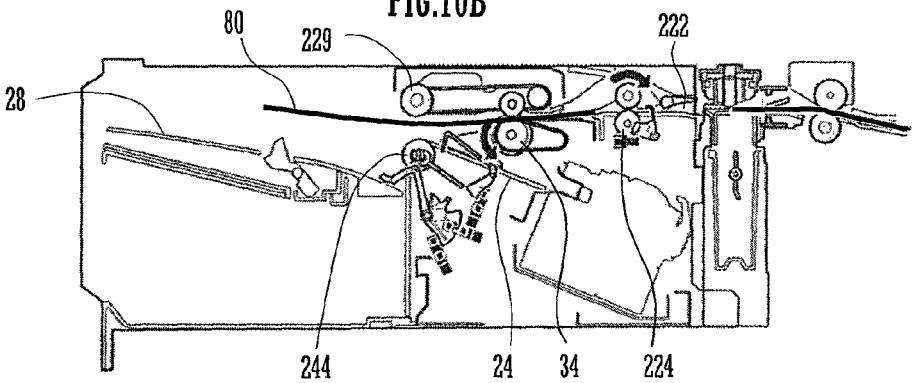
Figure 10C:
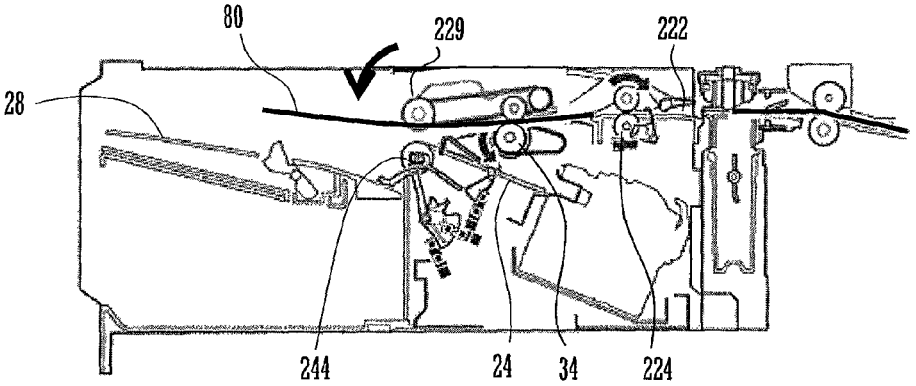
Figure 10D:
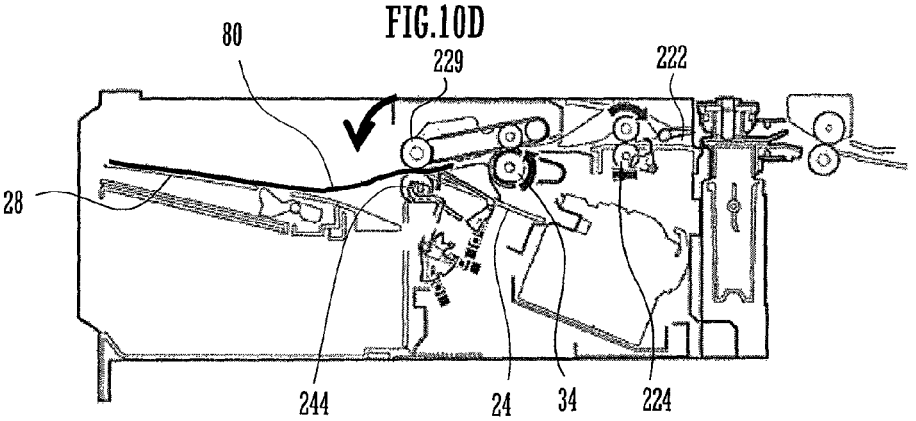

On the other hand, if the paper presently conveyed is the one belonging to the second kind such as thin paper or normal paper of not larger than A4 size as shown in FIG. 9, the paper 80 introduced into the introductory conveying path 222 is conveyed by the conveyance rollers 224 and 34 as shown in FIG. 10A and FIG. 10B. As shown in FIG. 10C, if the paper 80 belongs to the second kind, a timing of start of a descending motion of the upper paper discharge roller 229 is set so as to become earlier than if it belongs to the first kind, and the upper paper discharge roller 229 starts the descending motion in order that it comes into contact with the paper 80 before the paper 80 comes into contact with the paper receiving tray 28. As a result, as shown in FIG. 10D, the impetus of the paper 80 running out from the introductory conveying path 22 to the paper receiving tray 28 is reduced by a frictional force between the paper 80 and the upper paper discharge roller 229. Therefore, degrees of sliding and bouncing of the paper 80 after the leading edge of the paper 80 has collided against the paper receiving tray 28 are decreased, thereby suppressing a variation in the distribution of the paper on the paper receiving tray 28. Accordingly, an improved alignment of the paper 80 on the processing tray 24 is achieved, thereby increasing accuracy in performing the post-processing for the paper 80.

In the case where the paper 80 belongs to the second kind, the upper paper discharge roller 229 is permitted to rotate in the reverse conveyance direction when the upper paper discharge roller 229, being caused to descend, comes into contact with the paper 80 conveyed from the introductory conveying path 222 to the paper receiving tray 28. With the upper paper discharge roller 229 rotating in the reverse conveyance direction, the frictional force between the paper 80 and the upper paper discharge roller 229 increases, thereby further reducing the impetus of the paper 80 running out from the introductory conveying path 222 to the paper receiving tray 28. As a result, the variation in the distribution of the paper 80 on the paper receiving tray 28 is suppressed further.

Besides, in the case where the paper 80 belongs to the second kind, it is also possible that the upper paper discharge roller 229 is not permitted to rotate when the upper paper discharge roller 229, being caused to descend, comes into contact with the paper 80 conveyed from the introductory conveying path 222 to the paper receiving tray 28. With the upper paper discharge roller 229 not permitted to rotate, and thus by the frictional force between the paper 80 and the upper paper discharge roller 229, not only is the impetus of the paper 80 running out from the introductory conveying path 222 to the paper receiving tray 28 reduced, but also abrasion of the upper paper discharge roller 229 is suppressed.

Moreover, in the above-mentioned embodiment, the position of the leading edge of the paper 80 is calculated, as an example, using a result of detection by the paper sensor 226 installed in the vicinity of an inlet to the post-processing device 20 together with a paper conveyance speed; however, detection of the position of the paper 80 may be implemented otherwise by installing a paper detecting sensor to detect the leading edge of the paper 80 in the vicinity of either the upper paper discharge roller 229 or the lower paper discharge roller 244.

Additionally, the upper paper discharge roller 229 that has started the descending motion in order to come into contact with the paper 80 belonging to the second kind conveyed from the introductory conveying path 222 to the paper receiving tray 28, as an example, descends to the position where it contacts with the lower paper discharge roller 244 with pressure. However, the descending motion is not limited to descending at a constant rate to the position where it comes into contact with the lower paper discharge roller 244 with pressure. For example, the upper paper discharge roller 229 may be configured otherwise in such a manner as to stop once at a predetermined intermediate position before reaching the position where it comes into contact with the lower paper discharge roller 244 with pressure, and then to descend to the position where it comes into contact with the lower paper discharge roller 244 with pressure when the rear edge portion of the paper 80 has reached between the upper paper discharge roller 229 and the lower paper discharge roller 244.

Further, the upper paper discharge roller 229 may be configured otherwise in such a manner that the descending motion thereof is lowered within a predetermined intermediate range in between the raised position and the position where it comes into contact with the lower paper discharge roller 244 as compared with a range other than the predetermined intermediate range in between the raised position and the position, where the predetermined intermediate range is underside from a position at which the upper paper discharge roller 229 starts contacting with the paper 80 conveyed from the introductory conveying path 222 to the paper receiving tray 28. With the upper paper discharge roller 229 configured so as not to press down the paper 80 more than required, the paper 80 is prevented from being hurt, and abrasion of the upper paper discharge roller 229 is also suppressed. The position at which the upper paper discharge roller 229 starts contacting with the paper 80 is determined by an experiment.

In addition, thickness of the paper 80 can be determined by the control section 50 based on the setting input information on printing conditions by a user; however, a configuration including a detecting section such as optical sensor to detect the thickness of the paper 80 may also be possible.

As to which paper 80 to be classified under either the first kind or the second kind, shown in FIG. 9 is an example of a classification, and it is not limited to such.

Moreover, the upper paper discharge roller 229 is an example of an upper rotary body; and instead of the roller, an endless belt may be used. The lower paper discharge roller 244 is an example of a lower rotary body; and instead of the roller, an endless belt may be used.

Further still, the image forming section 14 is an example of a paper processing section; and a paper processing section is not limited to the image forming section 14.

Moreover, in the above-mentioned embodiment, an example was explained in which a post-processing device 20 according to an embodiment of the present invention is applied to the image forming apparatus 100; however, a paper processing apparatus to which the post-processing device 20 according to the present invention is applicable is not limited to an image forming apparatus.

The above explanation of the embodiment is nothing more than illustrative in any respect, nor should be thought of as restrictive. Scope of the present invention is indicated by claims rather than the above embodiment. Further, it is intended that all changes that are equivalent to a claim in the sense and realm of the doctrine of equivalence be included within the scope of the present invention.

What is claimed is:

1. A post-processing device that performs a post-processing for paper that has undergone a predetermined process, the device comprising:

an introductory conveying path into which the paper is introduced;

a processing tray onto which the paper having passed through the introductory conveying path is placed;

a post-processing section that performs the post-processing for the paper on the processing tray;

a paper receiving tray onto which the paper discharged from the processing tray is placed after having undergone the post-processing by the post-processing section;

a paper discharge section including a lower rotary body disposed at an edge portion on the paper receiving tray's side of the processing tray, and an upper rotary body installed so as to be capable of coming into contact with and away from the lower rotary body, the paper discharge section being freely rotatable in both a reverse conveyance direction by which the paper conveyed from the introductory conveying path onto the paper receiving tray is pulled back to the processing tray and a forward conveyance direction by which the paper placed on the processing tray is discharged onto the paper receiving tray; and a control section that controls an operation of the paper discharge section, wherein the control section causes a timing of start of a descending motion of the upper rotary body at the time when the paper is conveyed from the introductory conveying path to the paper receiving tray to become earlier if the paper belongs to a predetermined second kind than if the paper belongs to a predetermined first kind, the paper of the second kind being lighter weight than that of the first kind, then causes the upper rotary body to start the descending motion with the timing such that the upper rotary body comes into contact with the paper before the paper comes into contact with the paper receiving tray if the paper belongs to the second kind, and then causes the upper rotary body to rotate in the reverse conveyance direction when the upper rotary body descends if the paper belongs to the second kind.

2. A paper processing apparatus comprising the post-processing device as claimed in claim 1.

3. An image forming apparatus comprising the post-processing device as claimed in claim 1.

4. A post-processing device that performs a post-processing for paper that has undergone a predetermined process, the device comprising:

an introductory conveying path into which the paper is introduced;

a processing tray onto which the paper having passed through the introductory conveying path is placed;

a post-processing section that performs the post-processing for the paper on the processing tray;

a paper receiving tray onto which the paper discharged from the processing tray is placed after having undergone the post-processing by the post-processing section;

a paper discharge section including a lower rotary body disposed at an edge portion on the paper receiving tray's side of the processing tray, and an upper rotary body installed so as to be capable of coming into contact with and away from the lower rotary body, the paper discharge section being freely rotatable in both a reverse conveyance direction by which the paper conveyed from the introductory conveying path onto the paper receiving tray is pulled back to the processing tray and a forward conveyance direction by which the paper placed on the processing tray is discharged onto the paper receiving tray; and a control section that controls an operation of the paper discharge section, wherein the control section causes a timing of start of a descending motion of the upper rotary body at the time when the paper is conveyed from the introductory conveying path to the paper receiving tray to become earlier if the paper belongs to a predetermined second kind than if the paper belongs to a predetermined first kind, the paper of the second kind being lighter weight than that of the first kind, then causes the upper rotary body to start the descending motion with the timing such that the upper rotary body comes into contact with the paper before the paper comes into contact with the paper receiving tray if the paper belongs to the second kind, and causes the upper rotary body not to rotate when the upper rotary body descends if the paper belongs to the second kind.

5. A paper processing apparatus comprising the post-processing device as claimed in claim 4.

6. An image forming apparatus comprising the post-processing device as claimed in claim 4.

* * * * *